United States Patent [19]

Ahmed

[11] Patent Number: 4,564,536

[45] Date of Patent: Jan. 14, 1986

[54] AUTODEPOSITION COATING WITH REDUCED CLEANER EXUDATE

[75] Inventor: Bashir M. Ahmed, Ambler, Pa.

[73] Assignee: Amchem Products Inc., Ambler, Pa.

[21] Appl. No.: 710,187

[22] Filed: Mar. 11, 1985

[51] Int. Cl.[4] ..... B05D 1/18; B05D 3/10; B05D 7/14

[52] U.S. Cl. ..... 427/327; 427/318

[58] Field of Search ..... 427/327, 318

[56] References Cited

U.S. PATENT DOCUMENTS 4,243,704 1/1981 Hall et al. ..... 427/327

*Primary Examiner*—James R. Hoffman

*Attorney, Agent, or Firm*—Ernest G. Szoke; Henry E. Millson, Jr.; Mark A. Greenfield

[57] ABSTRACT

Staining of the finish coat on irregular workpieces caused by bleed-out of cleansing chemicals used in autodeposition coating processes is substantially eliminated by maintaining temperatures sufficiently constant to reduce or eliminate significant contraction or expansion of the metal fabric of the workpiece throughout the cleaning stage of the process.

14 Claims, No Drawings

AUTODEPOSITION COATING WITH REDUCED CLEANER EXUDATE

BACKGROUND OF THE INVENTION

In the automated pretreatment of workpieces prior to application of a finish coat, particular difficulties are presented by workpieces having irregularities such as seams and crevices. Liquids from the pretreatment cleaning baths tend to accumulate in these irregular surfaces and joints, and resist removal during standard rinse cycles. In consequence, residual liquids containing various pretreatment salts are present during finish coating and curing stages. Under the process conditions employed, the accumulated salts bleed out (exude) and stain the finish coat, often ruining the appearance of the finished product. The problem has been particularly observed on workpieces being prepared for autodeposition coating by pretreatment with cleaners prior to application of the autodeposition coating chemicals.

DESCRIPTION OF THE INVENTION

Autodeposition coating procedures which are improved by the process of the invention are characterized by three or four chemical stages prior to oven cure: Cleaning, optional pickling, coating and reaction rinse; it is the residual liquids from the cleaning and/or pickling stages which are prone to bleed-out on the cured finish coat. The autodeposition cleaning stages typically include at least two alkaline treatment baths and then an optional acid pickle bath, with intervening rinses. Owing to incomplete rinsing of topographically irregular workpieces after these pretreatment baths, residual salts are frequently exuded during cure of the finish coat, and manifested as white or brown streaking.

According to the process of the invention, both white and brown streaking of finished product caused by bleed-out of cleansing chemicals can be substantially eliminated by maintaining bath and rinse temperatures substantially constant during the steps of the cleaning stage to reduce or eliminate significant expansion and contraction of the metal fabric of the workpiece; the present process is thus differentiated from processes such as those described in U.S. Pat. No. 4,243,704 issued Jan. 6, 1981, wherein the coating stage of an autodeposition process is carried out within a specified temperature range. While the use of hot bath and rinse water is preferable to obtain optimum salt solubility, the critical feature of the invention comprises maintaining cleaning stage and pickling stage temperature conditions at a sufficiently consistent level to avoid substantial metal expansion and contraction during the cleaning stage. Visible salt stains of either brown or white type in the cured finish are thereby avoided.

Because various cleaning and pickling compositions in commercial use have optimum use temperatures widely ranging from about 110° F. (43° C.) to over 180° F. (82° C.), the maximum temperature differential, including all cleaning and pickling stages and rinses should be 35° F. (20° C.), preferably 20° F. (11° C.), most preferably 10° F. (6° C.). This will ensure optimum removal of the cleaner and/or pickle residues, without the need for further adjustment of the rinse water temperature. Obviously, this will only be operative where the cleaning and pickling steps are conducted within the above temperature differentials, which is a preferred embodiment. Where a temperature differential greater than those above exists, between the cleaning and pickling steps, then the after-rinses will have to be adjusted so that they are each within the above temperature differentials with reference to their respective treatment steps. Because of the resultant need for changing the rinse temperatures, this embodiment is less preferable.

In a typical cleaning sequence according to the process of the invention, a seamed or jointed oily metal workpiece such as a bracketed housing is subjected to a first spray clean step, a second dip clean step, a first tap water rinse, an acid pickle dip, and a second tap water rinse. Preferably, the sequence is terminated with a deionized water spray. The cleaned, rinsed workpiece is then immersed in the selected autodeposition coating chemicals, treated with a reactive rinse, and oven baked to cure the coating in a manner known in the autodeposition art. Both the first spray clean step and the second dip clean step typically employ well-known commercially available alkaline cleaning chemicals in amounts sufficient to provide a free alkali content (mL) of from about 5 to 15 in the first spray clean step and a free alkali content (mL) of from about 10 to 25 in the second dip clean step. Similar chemicals at strengths employed in comparable processes are generally useful. Exemplary alkaline cleansers commonly used in these cleaning steps are the "RIDOLINE" --27 series and the "RIDOLINE" --72 series which are commercially available cleaning agents for metal surfaces, each containing a sodium phosphate, sodium hydroxide, surfactants, and other ingredients. "RIDOLINE" is a trademark of Amchem Products, Inc., Ambler, Pa., U.S.A. Similarly, the acid pickle dip employs well-known, commercially available acid pickle chemicals in an amount sufficient to provide a bath usually having a free acid content (mL) of from about 5 to about 15. Useful acid cleansers include those containing phosphoric acid and similar chemicals employed in comparable process steps.

In addition to the five-step cleaning/pickling stage exemplified above, the process of the invention is equally applicable to cleaning stages having more or fewer than five steps. It is generally desirable to employ both acid and alkaline cleaners at the lowest concentration consistent with adequate cleaning to avoid the necessity of removing excessive salts.

As previously mentioned, the crux of the present invention is the discovery that residual salt build-up and subsequent exudation from surface irregularities is minimized if the temperature of the metal workpiece is maintained sufficiently constant over the course of the steps of the cleaning stage to avoid contraction and expansion of the metal. In known prior art processes, a temperature differential of at least 50° F. (28° C.) over the course of the cleaning and pickling stages is customary, with the cleansing chemicals typically applied at temperatures above about 120° F. (49° C.) the pickling chemicals applied at about 140° F. (60° C.), and the water rinses applied at temperatures below about 75° F. (24° C.), an alternating expansion and contraction of the workpiece results. In accordance with the present invention, it has surprisingly been discovered that this expansion and contraction is a significant factor in the build-up of residual salts in crevices, seams, joints, and other workpiece surface irregularities. In a preferred embodiment of the invention, the cleaning stage treatment liquids (both cleaning baths and rinses) are maintained at a hot temperature of at least about 120° F. (49° C.), and most preferably, of at least about 140° F. (60° C.). A final deionized water rinse (cf, e.g., Step 6, Table I, infra), if employed, may be applied at merely warm temperatures, such as about 70° to 90° F. (21° to 33° C.), if desired, without materially affecting results in most instances. For most metals, the above disclosed temperature differentials from one step of the cleaning stage to another will not cause sufficient expansion/contraction to mar the finish of the product with salt staining.

In another embodiment of this invention, the cleaning and optional pickling steps may be run at from ambient temperature up to 120° F. (49° C.) using a low temperature cleaner and pickling bath. A cleaner such as one of the "RIDOLINE" --89 series (a trademark of Amchem Products, Inc., Ambler, Pa.) could be employed at a temperature of 100° to 120° F. (38° to 49° C.). Other cleaners and pickling agents suitable for low temperatures are also known. Of course, regardless of the temperature chosen for the cleaning steps, the after-rinse and the optional pickling step and its after-rinse must all be approximately the same.

Where low temperature cleaning (and pickling) is employed, the rinse water may be unable to penetrate the seams, because of the water's relatively high surface tension. Moreover, the seams may be retaining salts from the cleaner or pickle, which entered because of the lower surface tension of the cleaner or pickle. In such circumstances, a substance should be added to the rinse water which will lower its surface tension to approximate that of the cleaner and pickle. Such a substance might be a water-miscible organic solvent such as a lower alkanol, or a surfactant of the same ionic nature as that employed in the cleaner or pickle.

However, a constant higher temperature (above 120° F. or 49° C.) is preferred because the seams are more easily penetrated by the rinse, the hot water more readily dissolves any salts remaining in the seams, and the added substance is not needed. This also avoids any possibility of contamination by the added rinse water substance, itself.

Since the cleaning and pickling operations are run at atmospheric pressure, the obvious upper temperature limit for the process of this invention is 212° F. (100° C.). However, an upper temperature limit of about 180° F. (82° C.) is preferred, and about 160° F. (71° C.) is most preferred. The temperature differentials as described earlier, are applicable regardless of whether the treatment is relatively high temperature or low temperature.

EXAMPLES

I. Bracketed automotive booster housings were cleaned and autodeposition coated according to the field conditions set forth in Table I:

TABLE I

| Step # | Parameters | First Day 1 | First Day 2 | First Day 3 | Second Day 1 | Second Day 2 | Second Day 3 |
|---|---|---|---|---|---|---|---|
| CLEANING AND PICKLING STAGES | | | | | | | |
| 1 | Temp. (°F.) | 130 | 140 | 140 | 138 | 140 | 135 |
| Spray Clean | Free Alk. (mL) | 11.4 | 10.7 | 11.9 | 9.0 | 8.8 | 12.5 |
| (RIDOLINE 1772) | Pressure (psi) | 18 | 18 | 18 | 18 | 18 | 18 |
| 2 | Temp. (°F.) | 140 | 140 | 140 | 140 | 140 | 140 |
| Dip Clean | Free Alk. (mL) | 21.8 | 20.5 | 22.5 | 21.6 | 19.8 | 21.8 |
| (RIDOLINE 1727) | | -- | | | | | |
| 3 | Temp. (°F.) | 112 | 121 | 120 | 122 | 125 | 120 |
| Tap Water Rinse* | Pressure (psi) | 23 | 23 | 23 | 23 | 23 | 23 |
| 4 | Temp. (°F.) | 140 | 132 | 136 | 136 | 135 | 136 |
| Acid Pickle Dip | Free Acid. (mL) | 10.9 | 10.0 | 10.3 | 10.9 | 11.2 | 10.7 |
| (phosphoric acid) | | | | | | | |
| 5 | Temp. (°F.) | 134 | 144 | 140 | 132 | 132 | 136 |
| Tap Water Rinse* | Pressure (psi) | 24 | 24 | 24 | 24 | 24 | 24 |
| Spray | | | | | | | |
| 6 | Conduc. (μS) | 20.7 | 22 | 20 | 22 | 10.6 | 10.0 |
| DI Water Rinse | Temp. (°F.) | 92 | 84 | 90 | 88 | 87 | 82 |
| Spray | Pressure (psi) | 30 | 30 | 30 | 30 | 30 | 30 |
| COATING STAGE | | | | | | | |
| 7 | ORP (mv) | 350 | 350 | 350 | 350 | 350 | 350 |
| Acrylic | T. Solids (%) | 5.64 | 5.68 | 5.7 | 5.53 | 5.66 | 5.9 |
| Copolymer | Fluoride (μA) | 195 | 200 | 200 | 200 | 220 | 200 |
| Latex coating | ST. Level (mL) | 10.6 | 11.5 | 11.1 | 10.7 | 10.8 | 10.8 |
| Chemical | Conduc. (μS) | 3000 | 3000 | 2800 | 3000 | 3000 | 3000 |
| | Repl. (gal) | 125 | — | — | — | 125 | — |
| 8 | Temp. (°F.) | 60 | 64 | 64 | 60 | 62 | 65 |
| Tap Water Rinse | Pressure (psi) | 1.5 | 1.5 | 1.5 | 1.5 | 1.5 | 1.5 |
| Dip | | | | | | | |
| 9 | Chr. Level (mL) | 8.2 | 8.1 | 8.4 | 8.4 | 8.2 | 8.2 |
| Reac. Dip Rinse | Temp. (°F.) | 70 | 70 | 70 | 70 | 71 | 72 |
| ("RIDOLINE" 1072 + surfactant) | | | | | | | |
| CURING STAGE | | | | | | | |
| (Oven) | | | | | | | |
| Zone 1 | Temp. (°F.) | 250 | 250 | 250 | 250 | 250 | 250 |
| Zone 2 | Temp. (°F.) | 350 | 350 | 350 | 350 | 350 | 350 |

*In known processes, these rinses were at ambient temperature.

No white bleed-out was observed on bracketed parts and brown bleed-out was observed on only 3% of bracketed parts. Best results were obtained when temperatures of steps 1–5 were about 140° F.

II. The procedure of Example I was followed, except that the temperature of Steps 1 and 2 was held at 140° F. (60° C.), of Steps 3 and 4 at 120° F. (49° C.), and of Step 5 at 130° F. (54.5° C.). Also, the concentration of Step 2 cleaner ("RIDOLINE" 1727) was reduced from the 4 oz/gal in Example I to 3 oz/gal, and the concentration of Step 4 phosphoric acid cleaner was reduced from the 15% (v/v) in Example I to 12% v/v. Bleed-out, both white and brown was virtually non-existent on bracketed parts.

COMPARATIVE EXAMPLE III

The procedure of Examples I and II was followed, employing the process conditions of Table II. Results: Heavy white run-down and brown streaking of the finish coat was observed:

TABLE II

| Step # | Parameters | First Day 1 | First Day 2 | First Day 3 | Second Day 1 | Second Day 2 | Second Day 3 | Third Day 1 | Third Day 2 | Third Day 3 | Fourth Day 1 | Fourth Day 2 | Fourth Day 3 |
|---|---|---|---|---|---|---|---|---|---|---|---|---|---|
| CLEANING AND PICKLING STAGES | | | | | | | | | | | | | |
| 1 Spray Clean (RIDOLINE 1772) | Temp. (°F.) | 148 | 144 | 140 | 140 | 142 | 140 | 142 | 140 | 140 | 140 | | 130 |
| | Free Alk. (mL) | 10.4 | 10.8 | 10.8 | 10.5 | 10.2 | 11.2 | 10.9 | 10.2 | 11.5 | 12.5 | | 13.2 |
| 2 Dip Clean (RIDOLINE 1727) | Temp. (°F.) | 160 | 160 | 160 | 160 | 160 | 160 | 160 | 160 | 160 | 160 | | 160 |
| | Free Alk. (mL) | 24.8 | 24.7 | 26.3 | 24.1 | 21.9 | 24.0 | 23.7 | 21.8 | 22.9 | 23.8 | | 16.5 |
| 3 Tap Water Rinse | Temp. (°F.) | 100 | 103 | 100 | 102 | 102 | 100 | 96 | 102 | 100 | 100 | | 74 |
| | Pressure (psi) | 18 | 30 | 185 | 18 | 24 | 30 | 24 | 28 | 24 | 24 | | 24 |
| 4 Acid Pickle Dip (phosphoric acid) | Temp. (°F.) | 140 | 137 | 145 | 140 | 138 | 140 | 137 | 118 | 140 | 140 | | 125 |
| | Free Acid. (mL) | 12.1 | 10.4 | 12.1 | 11.9 | 9.4 | 11.6 | 12.1 | 12.3 | 10.9 | 11.3 | | 11.3 |
| 5 Tap Water Rinse Spray | Temp. (°F.) | 60 | 68 | 68 | 66 | 66 | 68 | 68 | 64 | 66 | 66 | | 65 |
| | Pressure (psi) | 24 | 30 | 25 | 28 | 24 | 30 | 36.5 | 23 | 23 | 23 | | 18.5 |
| 6 DI Water Rinse Spray | Conduc. (μS) | 19 | 11.7 | 23 | 12.8 | 11.7 | 22 | 10.9 | 11.6 | 19 | 11.7 | | 24 |
| | Temp. (°F.) | 60 | 68 | 65 | 68 | 64 | 65 | 60 | 65 | 65 | 65 | | 65 |
| | Pressure (psi) | 30 | 30 | 30 | 30 | 30 | 30 | 30 | 30 | 30 | 30 | | 30 |
| COATING STAGE | | | | | | | | | | | | | |
| 7 Acrylic Copolymer Latex coating Chemical | ORP (mv) | 350 | 350 | 350 | 348 | 350 | 350 | 350 | 350 | 350 | 350 | | 350 |
| | T. Solids (%) | 6.33 | 5.82 | 6.12 | 5.6 | 5.8 | 5.9 | 5.7 | 5.8 | 5.88 | 5.67 | 5.9 | 5.87 |
| | Fluoride (μA) | 240 | 230 | 225 | 225 | 228 | 220 | 235 | 235 | 230 | 230 | | 240 |
| | ST. Level (mL) | 12.6 | 11.9 | 11.8 | 11.5 | 11.8 | 11.7 | 11.8 | 11.7 | 11.6 | 10.9 | | 11.7 |
| | Conduc. (μS) | 2500 | 2900 | 3000 | 2900 | 3000 | 2500 | 3000 | 3000 | 3000 | 3000 | | 2500 |
| | Repl. (gal) | — | — | — | — | 125 | — | 125 | — | — | 125 | | |
| 8 Tap Water Rinse Dip | Temp. (°F.) | 60 | 62 | 69 | 60 | 59 | 64 | 55 | 62 | 60 | 66 | | 66 |
| | Pressure (psi) | 2 | 3 | 2 | 2 | 1.5 | 2 | 1.5 | 1.5 | 1.5 | 1.5 | | 1.5 |
| 9 Reac. Dip Rinse ("RIDOLINE" 1072 + surfactant) | CHR. Level (mL) | 8.6 | 5.6 | 9.0 | 8.9 | 6.5 | 9.0 | 9.0 | 8.7 | 8.0 | 8.0 | | 9.0 |
| | Temp. (°F.) | 60 | 68 | 70 | 70 | 66 | 67 | 60 | 65 | 65 | 65 | | 66 |
| CURING STAGE | | | | | | | | | | | | | |
| Oven Zone 1 | Temp. (°F.) | 275 | 275 | 275 | 275 | 275 | 275 | 275 | 275 | 275 | 275 | | 275 |
| Zone 2 | Temp. (°F.) | 350 | 350 | 350 | 350 | 350 | 350 | 350 | 350 | 350 | 350 | | 350 |

The initial bath was with a coating chemical containing an acrylic copolymer latex, pigment, water, etc., which had a 5.7% solids content, and 1.3 g/l ion. In all three examples, monorails having a line speed of 9.8 ft/min carried the workpieces.

I claim:

1. In an autodeposition coating process of the type wherein a metal workpiece is first cleaned with cleaning chemicals in a cleaning stage, optionally subjected to a pickling stage, immersed in autodeposition chemicals to form an autodeposited coating in a coating stage, and then heated to cure the autodeposited coating in a curing stage, with water rinses between said stages, the improvement comprising maintaining the temperature of the workpiece sufficiently constant during the cleaning stage, optional pickling stage, and their respective water rinses, to substantially prevent expansion or contraction of the metal of the workpiece, so that bleed-out of the cleansing and/or pickling chemicals onto the cured coating is substantially eliminated.

2. The process of claim 1 wherein the temperatures of the cleaning stage, its after-rinse, the optional pickling stage, and its after-rinse, are all maintained at the temperature of the cleaning stage or the pickling stage, whichever is higher, with a maximum temperature differential in all steps of about 35° F.

3. The process of claim 2 wherein said higher temperature stage is between 110° F. and 180° F.

4. The process of claim 2 wherein said higher temperature stage is between 120° F. and 160° F.

5. The process of claim 2 wherein said cleaning stage comprises a first cleaning step, a second cleaning step, and a cleaning after-rinse.

6. The process of claim 5 wherein said pickling stage is present.

7. The process of claim 6 wherein said first cleaning step is an alkaline spray treatment, said second cleaning step is an alkaline dip treatment, and said pickling stage is an acid dip.

8. The process of claim 7 wherein said after-rinses are with tap water.

9. The process of claim 8 wherein the temperatures of: said first cleaning step is 125°–145° F., said second cleaning step is 135°–145° F., said cleaning after-rinse is 110°–130° F., said pickling stage is 130°–145° F., and said pickling after-rinse is 130°–145° F.

10. The process of claim 8 wherein the differential between the highest and lowest temperatures employed in all stages and rinses is 10° F.

11. The process of claim 2 wherein said after-rinses are with tap water.

12. The process of claim 1 wherein the temperatures of the cleaning stage, its after-rinse, the optional pickling stage, and its after-rinse, are all maintained at the temperature of the cleaning stage or the pickling stage, whichever is higher, with a maximum temperature differential in all steps of about 20° F.

13. The process of claim 12 wherein said higher temperature stage is between 110° F. and 180° F.

14. The process of claim 12 wherein said higher temperature stage is between 120° F. and 160° F.

* * * * *